United States Patent [19]

Campbell

[11] 4,186,955

[45] Feb. 5, 1980

[54] WASTE MATTER REMOVAL IMPLEMENT AND RECEPTACLE

[75] Inventor: Maury B. Campbell, Palo Alto, Calif.

[73] Assignee: Owl-Cam Inc., Palo Alto, Calif.

[21] Appl. No.: 874,211

[22] Filed: Feb. 1, 1978

[51] Int. Cl.[2] ..... A01K 29/00; A47L 13/52

[52] U.S. Cl. ..... 294/1 R; 15/104.8; 15/257.1; 206/223; 229/41 B; 294/55

[58] Field of Search ..... 294/1 R, 25, 55; 15/104.8, 257.1, 257.6; 206/216, 223, 496, 527; 229/32, 41 B

[56] References Cited

U.S. PATENT DOCUMENTS

| | | | |
|---|---|---|---|
| 2,243,825 | 5/1941 | Holtkamp | 229/41 B X |
| 2,957,617 | 10/1960 | Bolding | 229/41 B X |
| 3,027,999 | 4/1962 | Heroy | 206/223 |
| 3,286,826 | 11/1966 | Stoll | 206/223 |
| 3,639,937 | 2/1972 | Sweeney | 15/257.1 X |
| 3,676,887 | 7/1972 | Klein | 206/216 X |
| 3,767,247 | 10/1973 | Wetzler | 294/1 R |
| 3,885,266 | 5/1975 | Nafziger | 294/1 R X |
| 3,971,503 | 7/1976 | Allan et al. | 294/1 R X |

FOREIGN PATENT DOCUMENTS

| | | | |
|---|---|---|---|
| 1446895 | 8/1976 | United Kingdom | 206/223 |

*Primary Examiner*—Johnny D. Cherry
*Attorney, Agent, or Firm*—Flehr, Hohbach, Test

[57] ABSTRACT

An implement is provided for removing waste matter such as dog litter. The implement also forms a receptacle for convenient disposal. An envelope formed of sheet material such as cardboard opens to form a scoop with a detachable flap. When collapsed, the envelope holds a disposal bag and sanitary glove and the flap tucks into the scoop portion to form a convenient package.

7 Claims, 6 Drawing Figures

WASTE MATTER REMOVAL IMPLEMENT AND RECEPTACLE

BACKGROUND OF THE INVENTION

The present invention relates generally to cleaning implements, and more particularly to such implements which additionally serve as disposable receptacles for waste matter.

Removal of waste matter such as dog litter from sidewalks and yards is often accomplished using implements which become soiled and present a sanitary problem around the house. Cleaning up after pets also presents the problem of the proper disposal of the waste matter collected. Nevertheless, concerns over health and aesthetics and new laws in many communities have prompted increasing numbers of pet owners to clean up the litter created by their pets. The need for cleaning and storage of reusable implements for removing pet litter and the waste disposal problem both contribute significantly to the onerousness of the task.

OBJECTS AND SUMMARY OF THE INVENTION

It is a general object of the invention to provide a waste matter removal implement which is fully self-contained and is disposable.

It is another object of the invention to provide such an implement which also serves as a receptacle for waste matter.

It is another object of the invention to provide such an implement and receptacle which serves as an envelope prior to use for holding additional items to form a waste matter removal kit.

Accordingly, a waste matter removal implement and receptacle is provided which includes an envelope formed of sheet material folded along predetermined fold lines. The envelope has a receiving portion forming an enclosure with an opening, and a flap portion joined to the received portion along a first fold line which also forms a line of weakness. The flap portion tucks into the opening of the receiving portion to close the envelope. The flap portion is readily detachable from the receiving portion along the first fold line to form a cooperating member for pushing waste matter into the opening of the receiving portion.

Additional objects and features of the invention will be evident from the following description taken in conjunction with the accompanying drawings.

DESCRIPTION OF THE PREFERRED EMBODIMENT

Figure 1:
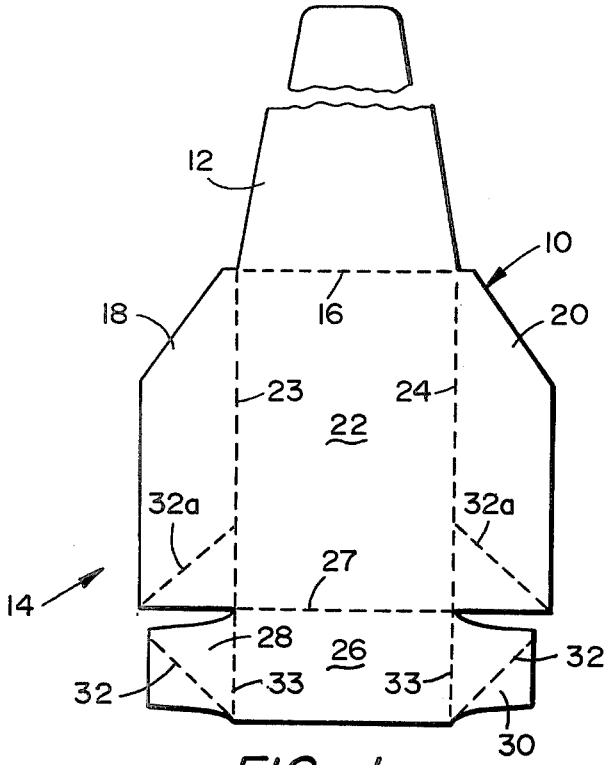
FIG. 1 is a plan view of a foldable blank sheet for use in forming the implement and receptacle of the present invention.

Referring to FIG. 1, the waste matter removal implement and receptacle of the invention includes an envelope which can be fabricated from a unitary blank of sheet material 10 such as cardboard. Blank 10 is provided with a plurality of predetermined fold lines which permit the blank to be folded into the shape of an envelope. The fold lines define separate panels of the sheet material which are folded together to form the envelope. A flap portion 12 of the envelope is joined to a receiving portion, as generally represented at 14, along a first fold line 16. Line 16 is perforated to form a line of weakness along which flap 12 is readily detachable from the remainder of the envelope. A pair of side panels 18 and 20 are joined to opposing edges of a bottom panel 22 along a pair of fold lines 23 and 24, respectively. An end panel 26 is joined to bottom panel 22 along a fourth fold line 27. The bottom panel 22, as defined by the four fold lines 16, 23, 24 and 27, can be substantially rectangular.

To facilitate the forming of the envelope, the end panel 26 is provided with oppositely extending tabs 28 and 30, each having a diagonal fold line 32. Cooperating fold lines **32*a* are similarly provided in the side panels 18 and 20. An envelope is formed by folding the end panel 26 upwardly along the line 27 and the tabs 28 and 30 inwardly about tab fold lines 33. Side panels 18 and 20 are now folded upwardly about fold lines 23 and 24, respectively, to bring the cooperating fold lines 32 and 32*a* into register. In such position the end tabs can be secured inwardly of the side panels by gluing, stapling, or in another convenient fashion, joining the end and side panels. As best illustrated in FIG. 3, the tab and side panel fold lines 32, 32*a* and 33, cooperate with one another such that the end panel 26 is collapsible over the side panels 18 and 20** to form an envelope.

Figure 3:
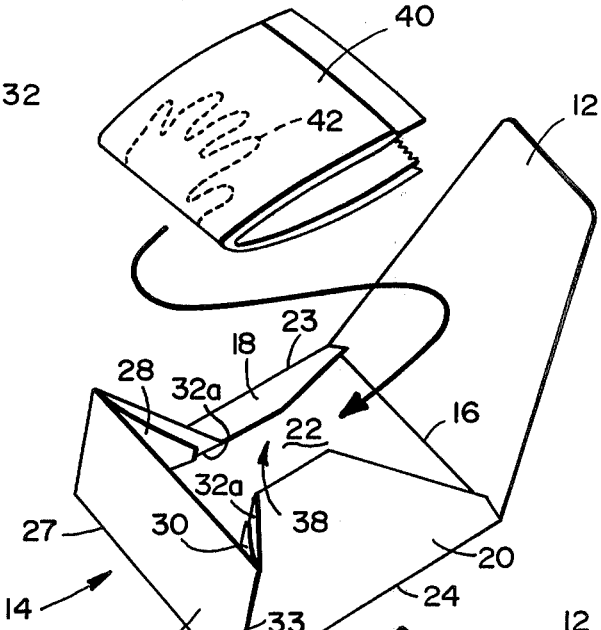
FIG. 3 is an elevational perspective view showing the assembly of the sheet material of FIG. 1 and the invention therein in accordance with the present invention.
Figure 4:
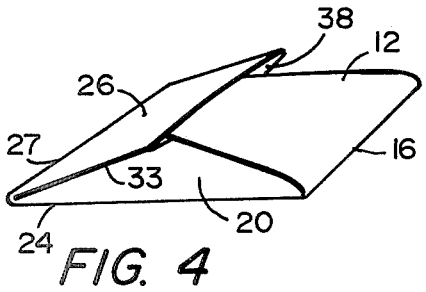
FIG. 4 is an elevational perspective view of a waste matter removal kit according to the invention in fully assembled merchandisable condition.

The initial conversion of the envelope described above to a merchandisable kit is generally represented by FIGS. 3 and 4. Thus, the side panels 18 and 20 and end panel 26 are movable relative to back panel 22 between the open position of FIG. 3, in which the side and end panels are substantially perpendicular to the bottom panel, and a collapsed position as shown in FIG. 4, in which the side and end panels overlie the back panel. Due to the cooperating folds between the side and end panels, all of the panels raise up together with the envelope is opened. The receiving portion 14 of the envelope is thus an enclosure having three sides (panels 18, 20, and 26) and a bottom (panel 22), with an opening 38 overlying the bottom and extending between the sides. To close the envelope, flap portion 12 tucks into opening 38 under the end panel 26 to achieve the collapsed position shown in FIG. 4. The envelope is opened by sliding flap 12 from beneath end panel 26 and then raising the end and side panels.

Figure 2:
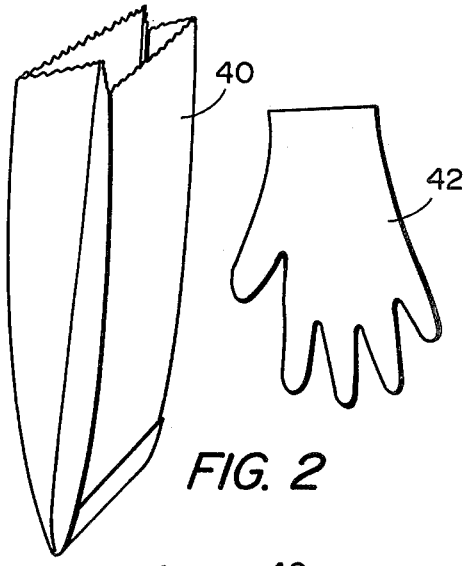
FIG. 2 is a perspective view of a disposal bag and glove for use in a kit according to the present invention.

Referring to FIG. 2, the invention additionally includes a disposal bag 40 and glove 42. Bag 40 is any suitable bag formed of a disposable material such as paper and preferably foldable to a size slightly smaller than bottom panel 22 of the envelope. Glove 42 is preferably a disposable clear plastic glove of the type which can be worn on either hand. To assemble a complete kit according to the invention, bag 40 and glove 42 are inserted in a completed envelope, as shown in FIG. 3. The envelope is then closed and the completed waste matter removal kit assumes a compact and convenient shape, as shown in FIG. 4.

Figure 5:
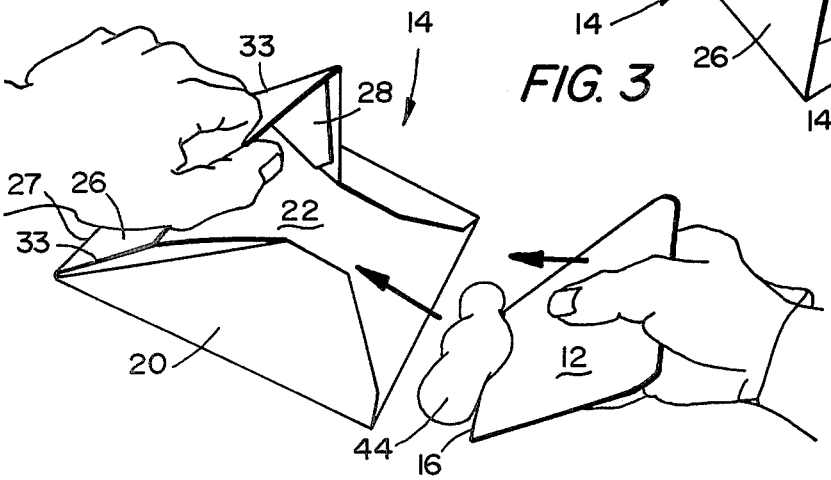
FIG. 5 is an elevational perspective view as in FIG. 3, on a reduced scale, illustrating the use of the invention.
Figure 6:
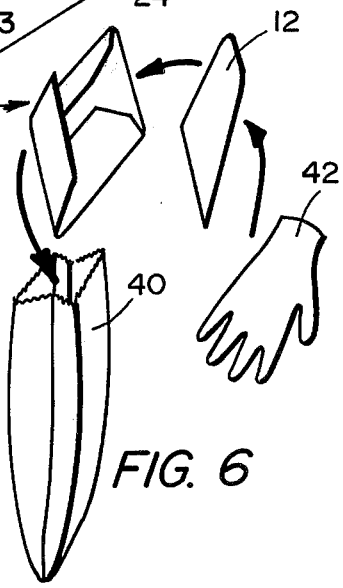
FIG. 6 is a view as in FIG. 5 illustrating the disposal procedure when using the present invention.

Use of the present invention is shown in FIG. 5. The kit is carried in the closed position until needed. To collect waste matter, the kit is opened and the bag and glove removed. After putting on the glove, the user detaches flap 12 from receiving portion 14 along the perforated line of weakness 16. The sides and end panels are raised to the open position to form receiving portion 14 into a scoop. With the user holding both receiver 14 and flap 12, as shown in FIG. 5, flap 12 is used to push waste matter 44 into opening 38 of the receiver 14. The receiver 14 can then be collapsed to form a retentive envelope. Following use, the receiver 14, flap 12 and glove 42 are all deposited in bag 40, as shown in FIG. 6, for convenient disposal.

The present invention provides a convenient and inexpensive kit which can be easily carried, for example in a coat pocket or purse. The kit is fully self-contained and affords maximum convenience and sanitation for the user. When formed as a scoop, the receiver 14 functions as a receptacle as well as a cleaning implement. Because of the low cost, the entire kit is simply thrown away, eliminating any need for subsequent cleaning or storage of the implement.

Alternative constructions are possible within the scope of the invention. For example, the envelope portion could assume other shapes. Also, the flap portion could have a different shape or be attached to a different portion of the envelope. In general, a waste matter removal implement is provided which is fully self-contained and disposable. The implement serves as a receptacle for waste matter. The invention further provides an envelope which serves to hold additional items forming a waste matter removal kit.

What is claimed is:

1. A waste matter removal implement and receptacle comprising an envelope formed of sheet material folded along predetermined fold lines, said envelope having a receiving portion forming an enclosure with an opening, and a flap portion joined to said receiving portion along a line of weakness, said receiving portion including a bottom panel, a pair of side panels joined to said bottom panel along a pair of said fold lines on opposite edges of said bottom panel, and an end panel joined to said bottom panel along another of said fold lines and also joined to said side panels, said pair of side panels and said end panel being movable relative to said bottom panel between a collapsed position in which said side and end panels overlie said bottom panel and an open position in which said side and end panels are substantially perpendicular to said bottom panel, said opening extending between said side panels and overlying said bottom panel such that said receiving portion forms a scoop having a bottom wall and three side walls, said flap portion tucking into said opening of said receiving portion to close said envelope, said flap portion being readily detachable from said receiving portion along said line of weakness to form a cooperating member for pushing waste matter into said opening of said receiving portion.

2. An implement and receptacle as in claim 1 together with a disposal bag in said envelope, said disposal bag being removable from said envelope to receive said flap portion and said receiving portion following use thereof.

3. An implement and receptacle as in claim 2 together with a disposable glove in said envelope.

4. A waste matter removal implement and receptacle comprising an envelope formed of sheet material folded along predetermined fold lines, said envelope including a substantially rectangular bottom panel, a flap portion joined to said bottom panel by a first of said fold lines along a first edge of said bottom panel, a pair of side panels joined to said bottom panel along a pair of said fold lines on opposite edges of said bottom panel and adjacent said first edge, and an end panel joined to said bottom panel along a fourth fold line on a fourth edge of said bottom panel opposite said first edge, said pair of side panels and said end panel being movable relative to said bottom panel between a collapsed position in which said side and end panels overlie said bottom panel, and an open position in which said side and end panels are substantially perpendicular to said bottom panel, said end panel also joining said side panels along a plurality of said fold lines which cooperate such that said end panel overlies said side panels when in said collapsed position, said bottom, side and end panels together forming an enclosure having an opening extending between said side panels and overlying said bottom panel, said flap portion tucking under said end panel when in said collapsed position to close said envelope, and said first fold line also being a line of weakness such that said flap portion can be readily detached from said enclosure to form a cooperating member for pushing waste matter into said opening of said enclosure.

5. An implement and receptacle as in claim 4 together with a disposal bag in said envelope, said disposal bag being removable from said envelope to receive said enclosure and said flap portion following use thereof.

6. An implement and receptacle as in claim 5 together with a disposable glove in said envelope.

7. A waste matter removal implement and receptacle comprising an envelope formed of sheet material folded along predetermined fold lines, said envelope having a receiving portion forming an enclosure with an opening, a flap portion joined to said receiving portion along a line of weakness, said receiving portion including a bottom panel, a pair of side panels joined to said bottom panel along a pair of said fold lines on opposite edges of said bottom panel, and an end panel joined to said bottom panel along another of said fold lines and also joined to said side panels, said pair of side panels and said end panel being movable relative to said bottom panel between a collapsed position in which said side and end panels overlie said bottom panel and an open position in which said side and end panels are substantially perpendicular to said bottom panel, said opening extending between said side panels and overlying said bottom panel such that said receiving portion forms a scoop having a bottom wall and three side walls, said end panel joining said pair of side panels along a plurality of said fold lines which cooperate such that said end panel overlies said side panels when in said collapsed position, said flap portion tucking under said end panel when in said collapsed position to close said envelope, and said flap portion being readily detachable from said receiving portion along said line of weakness to form a cooperating member for pushing waste matter into said opening of said receiving portion.

* * * * *